United States Patent [19]

Kandler et al.

[11] 4,139,369

[45] Feb. 13, 1979

[54] DESULPHURIZATION OF AN IRON MELT

[75] Inventors: Joachim Kandler, Erftstadt; Klaus Komorniczyk, Kerpen; Hans-Dieter Thiel, Hürth; Georg Strauss; Wilhelm Portz, both of Erftstadt; Albert Braun, Hürth-Burbach, all of Fed. Rep. of Germany

[73] Assignee: Hoechst Aktiengesellschaft, Frankfurt am Main, Fed. Rep. of Germany

[21] Appl. No.: 832,830

[22] Filed: Sep. 13, 1977

[30] Foreign Application Priority Data

Sep. 17, 1976 [DE] Fed. Rep. of Germany ..... 2641817

[51] Int. Cl.[2] ..... C21C 7/02

[52] U.S. Cl. ..... 75/58; 75/51; 75/52; 75/53

[58] Field of Search ..... 75/53, 58, 51, 52

[56] References Cited

U.S. PATENT DOCUMENTS

| | | | |
|---|---|---|---|
| 3,929,464 | 12/1975 | Todd | 75/58 |
| 3,998,625 | 12/1976 | Koros | 75/53 |

*Primary Examiner*—P. D. Rosenberg

*Attorney, Agent, or Firm*—Connolly and Hutz

[57] ABSTRACT

An iron melt is desulphurized. To this end, the irom melt is admixed with a powder mixture comprising metallic magnesium and at least one calcium compound, the latter being selected from calcium carbide, calcium oxide, calcium carbonate and dolomite, and the said calcium compound being used in the form of particles with a size of 0.06 to 3 mm, wherein the powder mixture contains 0.1 to 2.5 weight % of metallic magnesium in the form of particles having a size of 0.060 to 0.095 mm.

2 Claims, No Drawings

DESULPHURIZATION OF AN IRON MELT

This invention relates to the desulphurization of an iron melt with the aid of metallic magnesium.

Magnesium metal has a boiling point of 1105° C., which means, in the present context of iron melt desulphurization, that it is necessary for it to be used in the form of an aggregate which will be effective in regulating the rate of its vaporization, i.e. in the form of an alloy or mixture with another substance.

To this end, use has been made heretofore of (e.g.) mixtures of pulverulent metallic magnesium and magnesium oxide (cf. German Patent Specification ("Auslegeschrift") No. 2419176, Example 2) or of mixtures of pulverulent magnesium with quick-lime or dolomite (Institute of Ferrous Metallurgy, Dnepropetrovsk; Il'ich Metallurgical Plant, Zhdanov, USSR., Mettallurg No. 3 (1974), pages 12–15). Mixtures of pulverulent magnesium and calcium oxide have also been described and used, however, in the production of spheroidal graphite castings (Giesserei 45 (1958), pages 113–117).

The above mixtures have always been introduced into the iron melt by an injection method, e.g. with the use of a dip lance, in an attempt to use the magnesium as effectively as possible. In order to improve the effectiveness of this method, it has also been suggested that a mixture of pulverulent magnesium and calcium carbide should be pelletized (cf. German Patent Specification ("Offenlegungsschrift") No. 1508124) or briquetted (cf. U.S. Pat. No. 2,839,393) and introduced in such form into the melt. The pellets or briquettes were intended to prevent the pulverulent magnesium from reacting with the oxygen and nitrogen in the air present above the iron melt, to give MgO and $Mg_3N_2$ which have only a minor sequestering power for sulphur.

It is therefore an object of the present invention to provide a mixture containing metallic magnesium for the desulphurization of an iron melt, which mixture can effectively be injected into the iron melt but can also effectively be sprinkled in the form of a loose powder on to the iron melt, which melt may be accommodated in (e.g.) a vibrating pan or turbulence pan, or in a pan or container provided with solid (non-tubular) or tubular agitators, in which the iron melt is allowed to remain for an appropriate period of time to ensure desulphurization, or again in a pan or container in which the iron melt can be fluidized by means of gas introduced thereinto with the aid of a dip lance or through a porous brickwork lining. In developing our present technique, we initially assumed that coarse particulate magnesium powder with a size of 1 to 5 mm, upon being sprinkled on to the surface of the iron melt, would be slower to react with the oxygen and nitrogen in the air above the surface of the iron melt, and would thus, after complete incorporation with the melt, be more effective, than magnesium powder which was more finely divided and hence more reactive.

In marked contrast with this supposition, however, we have unexpectedly found that the desulphurizing efficiency of pulverulent magnesium increased with an increasing fineness of its particles (cf. Examples 1 to 3 hereinafter). Tests made on (e.g.) a mixture consisting of 99% of quicklime (CaO) with a particle size of 0.3 to 1 mm and 1% of magnesium powders of various particle sizes have shown an optimum desulphurizing efficiency for that mixture which contained magnesium with a particle size of 0.060 to 0.095 mm. We do not advise the use of pulverulent magnesium of even greater fineness inasmuch as it is liable to undergo self-ignition during its production and use, which are accordingly rendered hazardous.

Apart from this, a synergistic effect has surprisingly been found to accompany the use of our present mixtures containing metallic magnesium. Even if the magnesium (particle size = 0.060–0.095 mm) is assumed to have a 100% (theoretical) efficiency, the principal component in the mixture (which, as specified below, comprises CaO, $CaCO_3$, $CaC_2$ or $CaMg(CO_3)_2$) actually proves more effective in combination with this magnesium than if used alone. This effect has been demonstrated with mixtures containing 0.1 to 2.5 weight % of metallic Mg (cf. Examples 3–4; 5–6; and 7–8–9).

The present invention relates broadly to a process for the desulphurization of an iron melt comprising adding to the melt a powder mixture comprising metallic magnesium and at least one calcium compound, the latter being represented by at least one of calcium carbide, calcium oxide, calcium carbonate, and dolomite, and the said at least one calcium compound being used in the form of particles with a size of 0.06 to 3 mm, wherein the powder mixture contains 0.1 to 2.5 weight % of metallic magnesium in the form of particles having a size of 0.060 to 0.095 mm.

A preferred feature of th present process provides for the powder mixture to be used in a proportion of 0.2 to 1.2 weight % calculated on the weight of the iron melt.

The following Examples illustrate the invention:

EXAMPLE 1: (Comparative Example)

500 g of a mixture consisting of 495 g of quicklime (97 weight % CaO; particle size 0.3 to 1.0 mm) and 5 g of metallic magnesium powder (particle size 1.0 to 1.5 mm) was stirred at 1480° C. by means of a refractory beam stirrer (80 rpm) into 50 g of a melt of cast iron. The melt contained 3.4 weight % of carbon, 1.8 weight % of silicon, 0.6 weight % of manganese, and 0.145 % of sulphur, and was placed in the crucible of an induction furnace.

After an agitation period of 10 minutes, the melt was freed from slag and an iron specimen was taken therefrom. It contained 0.134 weight % of sulphur. This corresponded, irrespective of any potential desulphurizing efficiency of the quicklime, to a 83% degree of desulphurizing efficiency of magnesium (formation of MgS).

EXAMPLE 2: (Comparative Example)

50 kg of molten cast iron (sulphur content = 0.134 weight %) was treated as described in Example 1 with 500 g of a mixture consisting of 495 g of quicklime (97 weight % CaO; particle size = 0.3 to 1.0 mm) and 5 g of pulverulent magnesium (particle size = 0.315 to 0.500 mm). Under the conditions described in Example 1, the sulphur content reached a final value of 0.119 weight %. This corresponded to a 114% degree of efficiency of the magnesium, i.e. 0.3% of the quicklime, referred to 97 weight % CaO, participated additionally in the desulphurization.

EXAMPLE 3

50 kg of molten cast iron (sulphur content = 0.138 weight %) was treated as described in Example 1 with 500 g of a mixture of 495 g of quicklime (97 weight % CaO; particle size = 0.3 to 1.0 mm) and 5 g of pulverulent magnesium (particle size = 0.060–0.095 mm).

Under the conditions described in Example 1, the sulphur content reached a final value of 0.117 weight %. This correspond to an apparent 159% degree of efficiency of the magnesium, i.e. 1.42% of the quicklime, referred to 97 weight % of CaO, participated additionally in the desulphurization.

EXAMPLE 4: (Comparative Example)

50 kg of molten cast iron (sulphur content = 0.140 weight %) was treated as described in Example 1 with 500 g of quicklime (97 weight % of CaO; particle size = 0.3 to 1.0 mm). Under the conditions described in Example 1, the sulphur content reached a final value of 0.134 weight %. This corresponded only to a 1.09% degree of efficiency of the quicklime, referred to 97 weight % of CaO.

EXAMPLE 5: (Comparative Example)

700 kg of calcium carbide (particle size = 0.3 to 1.0 mm) was stirred at 1300° C. within 10 minutes and with the aid of a refractory beam stirrer (65 rpm) into 120 metric tons of molten pig iron (sulphur content = 0.040 weight %), which was placed in a transport pan. After the treatment described, the sulphur content was 0.020 weight %. This corresponded to a 9 % degree of efficiency of the above 80% commercial grade calcium carbide.

EXAMPLE 6

137 metric tons of molten crude iron (sulphur content = 0.043 weight %) was treated as described in Example 5 at 1270° C. with 700 kg of a mixture of 693 kg of $CaC_2$ (particle size = 0.3 to 1.0 mm) and 7 kg of pulverulent Mg (particle size = 0.060–0.095 mm). The melt was freed from slag, and a specimen was taken therefrom and found to contain 0.009 weight % of sulphur.

In other words, 46.6 kg of sulphur were found to have been removed from the melt. For a 100% degree of efficiency, 7 kg of pulverulent Mg would be capable of sequestering 9.2 kg of sulphur. The balance of 37.4 kg of sulphur was sequestered by $CaC_2$. This corresponded to a 13.5% degree of efficiency for 693 kg of commercial grade calcium carbide containing 80 weight % of $CaC_2$.

EXAMPLE 7: (Comparative Example)

1500 kg of molten cast iron (sulphur content = 0.053 weight %) which was placed in a vibrated pan was treated at 1520° C. with 16 kg of commercial grade calcium carbide (particle size = 1 to 3 mm). After vibration for 4 minutes, the cast iron was found to contain 0.007 weight % of sulphur. This corresponded to an 11 % degree of efficiency of the 80 % $CaC_2$.

EXAMPLE 8

1500 kg of molten cast iron (sulphur content = 0.056 weight %) which was placed in a vibrated pan was desulphurized at 1520° C. with 10 kg of a mixture of 9900 g of commercial grade $CaC_2$ (80 %; particle size = 1 to 3 mm) and 100 g of pulverulent magnesium (particle size = 0.060–0.095 mm). After a vibration period of 4 minutes, the final sulphur content was 0.004 weight %.

If the degree of efficiency of the magnesium as in Example 6 is taken as 100%, then 132 g of sulphur of the overall quantity of 780 g removed was sequestered by the 100 g of magnesium. The balance of 648 g of sulphur was sequestered by $CaC_2$, corresponding to a 16 % degree of efficiency.

EXAMPLE 9

1500 kg of molten cast iron was desulphurized in the manner described in Examples 7 and 8 with 8 kg of a mixture of 7840 g of $CaC_2$ (80%, particle size = 1 to 3 mm) and 160 g of pulverulent magnesium (particle size = 0.060–0.095 mm). The initial sulphur content of 0.054 weight % was reduced down to 0.002 weight %. For a 100 % degree of efficiency of the pulverulent magnesium, 211 g of S was sequestered by magnesium and 569 g of S was sequestered by calcium (total quantity sequestered = 780 g). This corresponded to an 18 % degree of efficiency of the commercial grade $CaC_2$.

We claim:

1. In the process for the desulphurization of an iron melt comprising adding to the melt a powder mixture comprising metallic magnesium and at least one calcium compound, the latter being selected from the group consisting of calcium carbide, calcium oxide, calcium carbonate and dolomite, and the said at least one calcium compound being used in the form of particles with a size of 0.06 to 3 mm, the improvement which comprises adding a powder mixture containing 0.1 to 2.5 weight % of metallic magnesium in the form of particles having a size of 0.060 to 0.095 mm.

2. A process as claimed in claim 1, wherin the powder mixture is used in a proportion of 0.2 to 1.2 weight %, calculated on the weight of the iron melt.

* * * * *